US005402863A

United States Patent [19]

Okumura et al.

[11] Patent Number: 5,402,863

[45] Date of Patent: Apr. 4, 1995

[54] APPARATUS TO AUTOMATICALLY ADJUST SPRING TENSION OF AN ELEVATOR BRAKE TO MAINTAIN BRAKE TORQUE

[75] Inventors: Masahide Okumura; Shigemi Iwata; Hiroyuki Ikejima, all of Inazawa, Japan

[73] Assignee: Mitsubishi Denki Kabushiki Kaisha, Tokyo, Japan

[21] Appl. No.: 147,472

[22] Filed: Nov. 5, 1993

Related U.S. Application Data

[63] Continuation-in-part of Ser. No. 889,419, May 28, 1992, abandoned.

[30] Foreign Application Priority Data

May 29, 1991 [JP] Japan ..... 3-125870

[51] Int. Cl.[6] ..... B66B 1/32

[52] U.S. Cl. ..... 187/288; 187/351

[58] Field of Search ..... 187/108, 113, 109, 126, 187/131, 130, 100, 105, 73, 77

[56] References Cited

U.S. PATENT DOCUMENTS

| | | | |
|---|---|---|---|
| 3,613,835 | 10/1971 | Vizzotto | 187/29 |
| 4,518,062 | 5/1985 | Makinen et al. | 187/29 R |
| 4,984,659 | 1/1991 | Nomura . | |
| 4,987,977 | 1/1991 | Nomura | 187/112 |
| 5,244,060 | 9/1993 | Tanaka et al. | 187/20 |

FOREIGN PATENT DOCUMENTS

| | | | |
|---|---|---|---|
| 4-313582 | 11/1992 | Japan | 187/108 |

*Primary Examiner*—Steven L. Stephan
*Assistant Examiner*—Robert Nappi
*Attorney, Agent, or Firm*—Leydig, Voit & Mayer

[57] ABSTRACT

An elevator adjusting apparatus for adjusting a brake torque produced by a brake for braking travel of an elevator cage includes a brake torque adjustment mode setting unit for setting an adjustment mode for the brake torque, a cage position recognizing unit for recognizing a cage position, a cage speed detecting unit for detecting a cage speed, a brake actuation command generating unit for reissuing a brake actuation command generating unit for issuing a brake actuation command when the brake torque adjustment mode is set by the brake torque adjustment mode setting unit and the cage position recognizing unit recognizes that the cage position has reached a predetermined position of a lift passage, a brake control unit for actuating the brake in response to the brake actuation command issued from the brake actuation command generating unit, and a brake torque calculating unit for calculating the brake torque based on the cage speed detected by the cage speed detecting unit during the brake actuation. With the apparatus, the brake torque can be adjusted simply accurately and efficiently without using any weights.

10 Claims, 9 Drawing Sheets

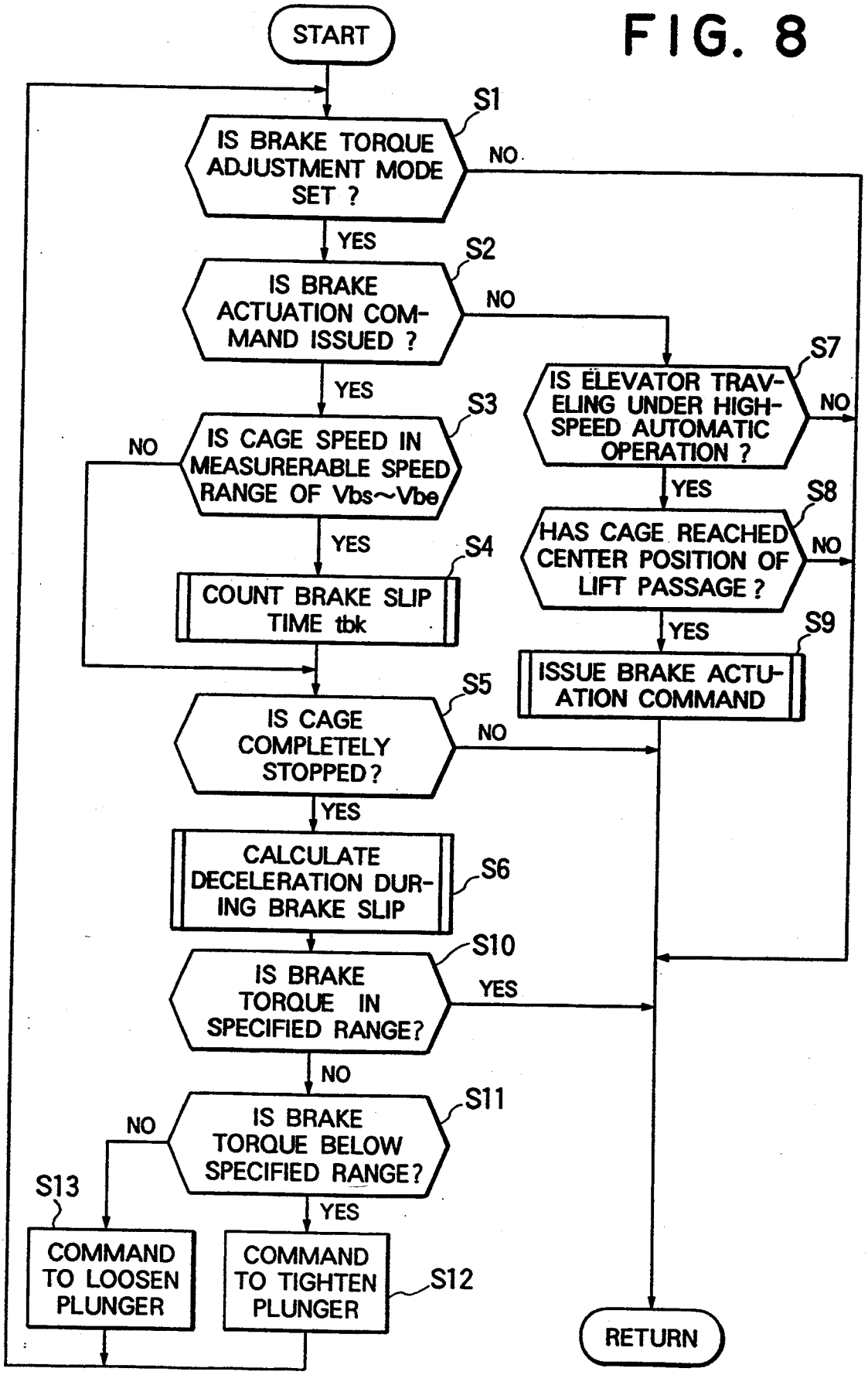
FIG. 8
START
S1
IS BRAKE TORQUE ADJUSTMENT MODE SET ?
NO
YES
S2
IS BRAKE ACTUATION COMMAND ISSUED ?
NO
YES
S3
IS CAGE SPEED IN MEASURERABLE SPEED RANGE OF Vbs~Vbe
NO
YES
S4
COUNT BRAKE SLIP TIME tbk
S5
IS CAGE COMPLETELY STOPPED?
NO
YES
CALCULATE DECELERATION DURING BRAKE SLIP
S6
S10
IS BRAKE TORQUE IN SPECIFIED RANGE?
YES
NO
S11
IS BRAKE TORQUE BELOW SPECIFIED RANGE?
NO
YES
S13
COMMAND TO LOOSEN PLUNGER
COMMAND TO TIGHTEN PLUNGER
S12
S7
IS ELEVATOR TRAVELING UNDER HIGH-SPEED AUTOMATIC OPERATION ?
NO
YES
S8
HAS CAGE REACHED CENTER POSITION OF LIFT PASSAGE ?
NO
YES
S9
ISSUE BRAKE ACTUATION COMMAND
RETURN

APPARATUS TO AUTOMATICALLY ADJUST SPRING TENSION OF AN ELEVATOR BRAKE TO MAINTAIN BRAKE TORQUE

This application is a continuation-in-part of application Ser. No. 07/889,419, filed May 28, 1992, abandoned.

BACKGROUND OF THE INVENTION

1. Field of the Invention

The present invention relates to an elevator adjusting apparatus, and more particularly to an apparatus capable of adjusting a brake torque.

2. Description of the Related Art

One conventional elevator adjusting apparatus of the above type is disclosed in Japanese Patent Laid-Open No. 1-197290 which corresponds to U.S. Pat. No. 4,984,659.

FIG. 9 is a front view showing an electromagnetic brake integrally assembled to a hoist of an elevator in the prior art.

In the drawing, denoted by reference numeral 50 is a pair of brake levers each of which is normally biased by a spring 51 in the direction of arrow A. 52 is a brake shoe attached to each of the brake levers 50; 53 is a brake wheel rotating together with a electric motor (not shown); and 54 is a rotatable shaft directly coupled to the electric motor (not shown), the brake wheel 53 being fixed to the rotatable shaft 54. A substantially L-shaped cam 55 turns in the direction of arrow B upon movement of the brake lever 50 in the direction of arrow A. A plunger 56 is held in abutment against distal ends of the cams 55 and 57 is a brake coil for attracting and moving the plunger 56 upon supply of electric power.

In the electromagnetic brake thus arranged, the brake levers 50 are normally biased by the springs 51 in the directions of arrows A,.respectively. This biasing causes the brake shoes 52 to grasp the brake wheel 53 for arresting its rotation. In this state, the cams 55 are turned in the directions of arrows B to push up the plunger 56. When electric power is supplied to the brake coil 57, the plunger 56 is attracted by the brake coil 57 to descend. With such a descent, the cams 55 are turned in the directions of arrows C, whereby the brake levers 50 are turned in the directions of arrows D against the urging forces of the springs 51. Upon the brake levers 50 being turned in this way, the brake shoes 52 release the brake wheel 53 from its arrested state. As a result, the rotatable shaft 54 can be driven by the electric motor to ascend or descend the elevator on demand.

This type braking mechanism is indispensable from the viewpoint of securing safety of elevators, and all the load is applied to the brake when the elevator is stopped. At this time, if a brake tightening torque is not sufficient, the brake would cause a slip, which is seriously dangerous. Conversely, if the brake tightening torque is too strong, a stop shock would be very large when the elevator is quickly stopped, which is also dangerous. For that reason, it is required to appropriately adjust such a brake tightening torque. As used herein the term "brake tightening torque" (hereinafter referred to simply as a brake torque) is defined as the movement exerted by a braking mechanism about a shaft necessary to prevent the elevator cage from slipping when the shaft is not rotating.

Heretofore, the brake torque has been adjusted by a method of once loading a weight on the order of 125% of the cage load, and adjusting the biasing forces of the springs 51 in a machinery room so that the brake does not slip. Thus, the conventional elevator adjusting apparatus adopts the electromagnetic brake as a braking mechanism, and the weight on the order of 125% of the cage load must be loaded on the cage in the conventional method of adjusting the brake torque. Additionally, after completion of the adjustment, the weight must be unloaded from the cage, meaning that a great deal of labor and time are necessary.

Furthermore, because the conventional adjusting method only adjusts the brake torque in such a manner as to prevent a slip of the brake, the brake may be often tightened too strong or too weak. Thus, it has not been easy to adjust the brake torque in conformity with desired standards.

SUMMARY OF THE INVENTION

An object of the present invention is to provide an elevator adjusting apparatus capable of adjusting a brake torque simply, accurately and efficiently without having to load a weight in the elevator cage.

An elevator adjusting apparatus according to the present invention comprises brake torque adjustment mode setting means for setting an adjustment mode for the brake torque, cage position recognizing means for recognizing a cage position, cage speed detecting means for detecting a cage speed, brake actuation command generating means for issuing a brake actuation command when the brake torque adjustment mode is set by said brake torque adjustment mode setting means and said cage position recognizing means recognizes that the cage position has reached a predetermined position of a lift passage, brake control means for actuating said brake in response to the brake actuation command issued from said brake actuation command generating means, and brake torque calculating means for calculating the brake torque based on the cage speed detected by said cage speed detecting means during the brake actuation.

BRIEF DESCRIPTION OF THE DRAWINGS

FIG. 8 is a flowchart showing operation of the second embodiment.

DESCRIPTION OF THE PREFERRED EMBODIMENTS

Hereinafter, preferred embodiments of the present invention will be described with reference to the attached drawings.

First Embodiment

Figure 1:
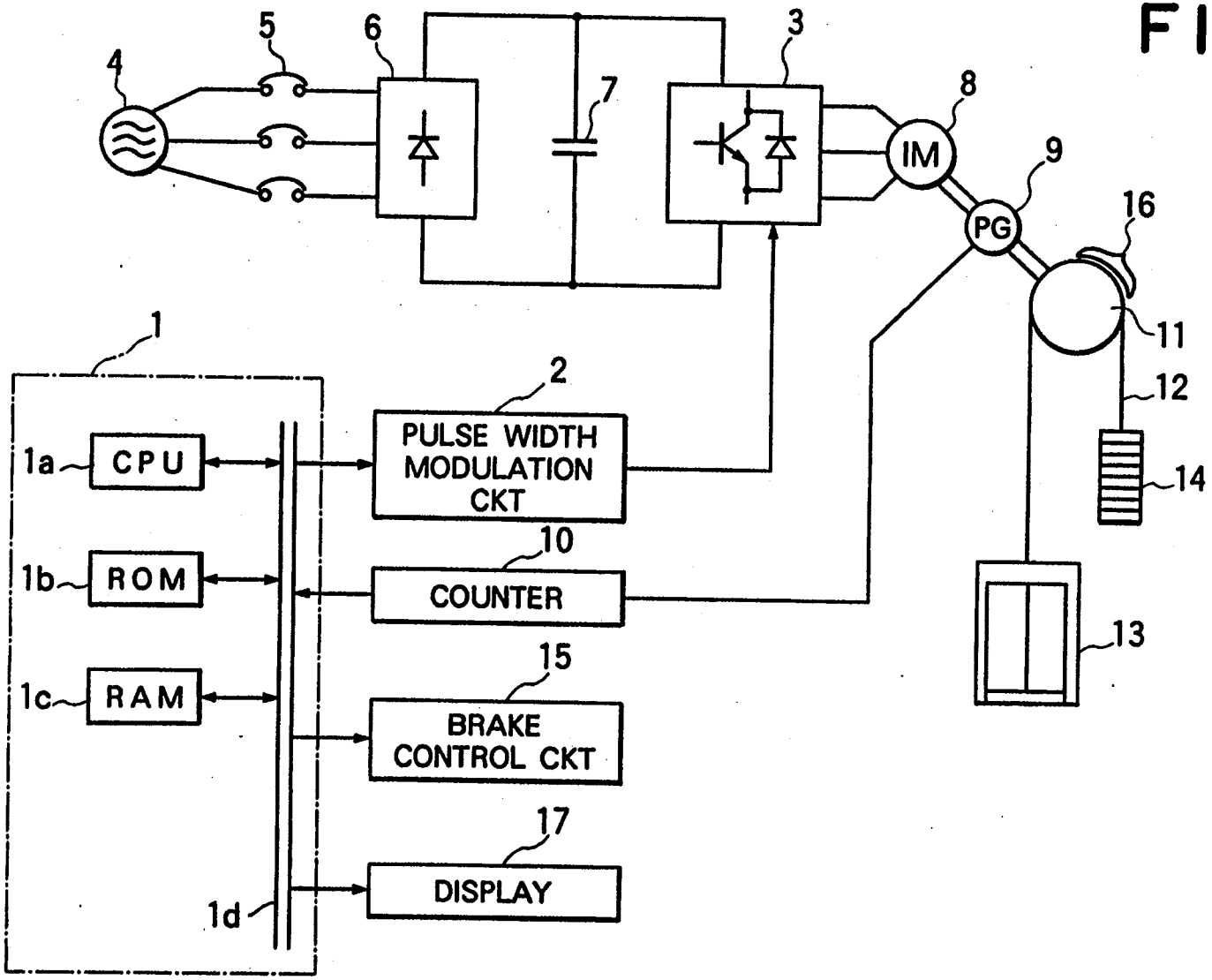
FIG. 1 is a block diagram showing an entire system of an elevator adjusting apparatus according to a first embodiment of the present invention.
Figure 9:
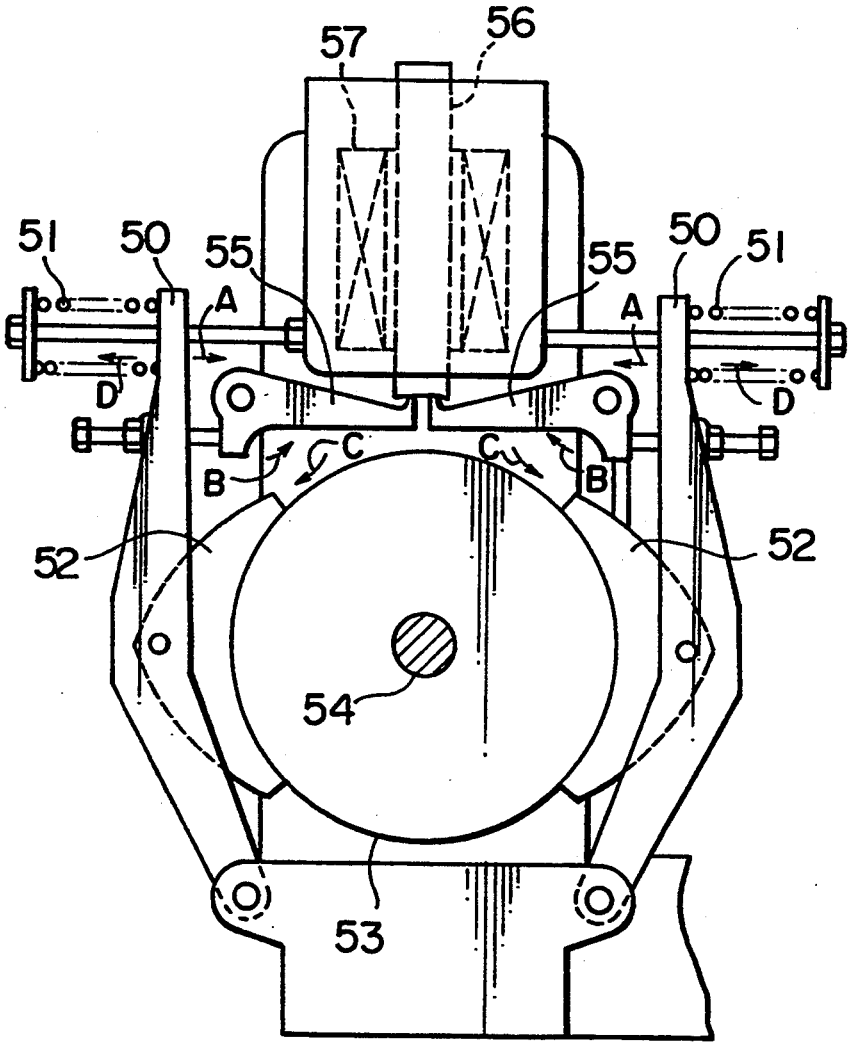
FIG. 9 PRIOR ART
FIG. 9 is a view showing a conventional electromagnetic brake.

In FIG. 1, denoted by reference numeral 1, is a microcomputer for controlling operation of an elevator. The microcomputer includes a CPU 1*a*, a read-only memory (ROM) 1*b*, a random access memory (RAM) 1*c*, and a bus 1*d* interconnecting these members. Reference numeral 2 is a well-known pulse width modulation circuit for modulating and controlling a pulse width of square pulses in accordance with a voltage command value output from the microcomputer 1. Reference numeral 3 is an inverter for transforming a DC current into an AC current of variable voltage and variable frequency in accordance with the pulses controlled by the pulse width modulation circuit 2. Reference numeral 4 is a three-phase AC power supply. Reference numeral 5 is a breaker connected to the three-phase AC power supply. Reference numeral 6 is a converter for transforming a three-phase AC current into a DC current. Reference numeral 7 is a smoothing capacitor for smoothing the DC current and supplying it to the inverter 3. Reference numeral 8 is an induction motor for a hoist driven and controlled by the inverter 3. Reference numeral 9 is a pulse generator directly coupled to the induction motor 8 for generating pulses corresponding to a rotational speed of the induction motor 8. Reference numeral 10 is a counter for counting the pulses generated from the pulse generator 9. Reference numeral 11 is a sheave driven by the induction motor 8. Reference numeral 12 is a rope wound around the sheave. Reference numeral 13 is an elevator cage joined to one end of the rope 12. Reference numeral 14 is a counterweight joined to the other end of the rope 12. Reference numeral 15 is a brake control circuit for actuating an electromagnetic brake 16 in accordance with a command from the microcomputer 1. Reference numeral 16 is an electromagnetic brake of the similar construction to the conventional one explained before by referring to FIG. 9. Reference numeral 17 is a display or indicator for indicating various information from the microcomputer 1.

Figure 2:
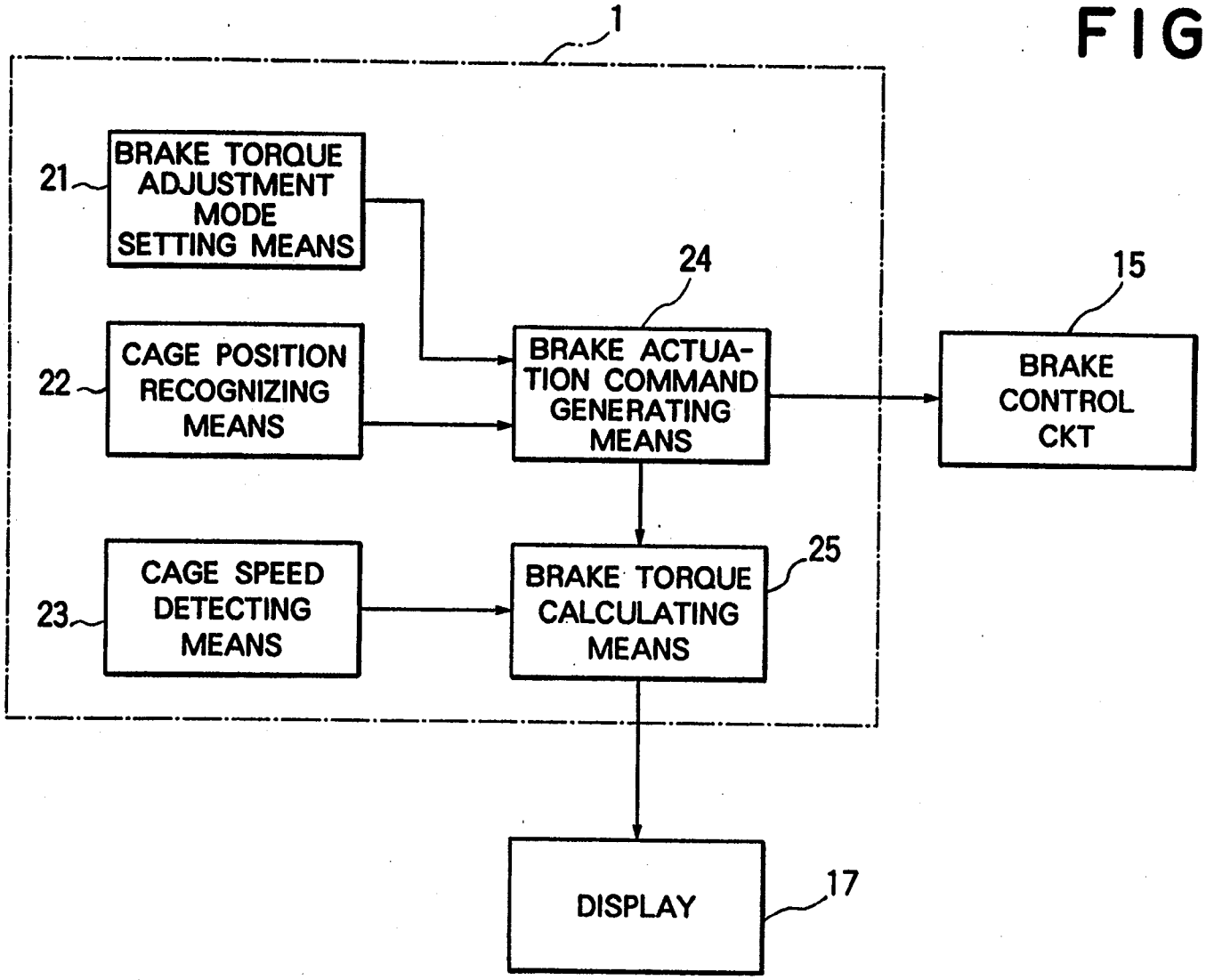
FIG. 2 is a functional block diagram of a microcomputer is FIG. 1.

An elevator adjusting apparatus of this embodiment is arranged as mentioned above and includes a mechanism for calculating a brake torque of the electromagnetic brake 16 as shown in FIG. 2.

In FIG. 2, denoted by reference numeral 21 is brake torque adjustment mode setting means for setting an adjustment mode for the brake torque. Reference numeral 22 is cage position recognizing means for calculating a cage position while the elevator is traveling. Reference numeral 23 is cage speed detecting means for detecting a speed of the cage 13 that changes moment by moment. Reference numeral 24 is brake actuation command generating means for issuing a brake actuation command based on both outputs of the brake torque adjustment mode setting means 21 and the cage position recognizing means 22, and then outputting the command to the brake control circuit 15. Reference numeral 25 is brake torque calculating means for calculating a brake torque based on the value obtained by the cage speed detecting means 23 when the brake actuation command generating means 24 is outputting the brake actuation command. The calculated result is indicated on the display 17. The above arithmetic operations are executed in the microcomputer 1.

The process of calculating the brake torque by the elevator adjusting apparatus of this embodiment will be next described with reference to a flowchart of FIG. 3. First, it is determined in a step S1 whether or not the brake torque adjustment mode is set. If not, then operations from steps S2 to S9 are skipped. If the brake torque adjustment mode is set, then it is determined in a step S2 whether or not the brake actuation command is turned "on". If the brake actuation command is not turned "on", then the process goes to a step S7 to determine whether or not the elevator is traveling under high-speed automatic operation. If the elevator is not traveling under high-speed automatic operation, then the brake torque calculating process is not further executed. If the elevator is determined in the step S7 as traveling under high-speed automatic operation, then it is determined in a step S8 whether or not the elevator cage 13 has reached the center position of a lift passage. This determination is made by the cage position recognizing means 22. If the elevator cage 13 is determined as having reached the center position of the lift passage, then the brake actuation command is generated in a step S9 to actuate the electromagnetic brake 16 via the brake control circuit 15. If the elevator cage 13 is not determined as having reached the center position of the lift passage, then the process is ended without generating the brake actuation command. In the above, the recognition of the cage position by the cage position recognizing means 22 is carried out in parallel to the travel of the elevator cage 13 by detecting the amount of movement of the elevator cage 13, calculating the current position of the elevator cage 13, and recognizing the center position of the lift passage.

On the other hand, if the brake actuation command is turned "on" in the step S2, then the process goes to a step S3 to detect a cage speed V under the brake actuation by the cage speed detecting means 23 and determine whether or not the cage speed V is in a brake torque measurable range of Vbs to Vbe. If so, then a time during which the cage speed V remains within the brake torque measurable range is counted as a brake slip time tbk in a step S4. After that, it is determined in a step S5 whether or not the elevator cage 13 is completely stopped. If the elevator cage 13 is completely stopped, then a mean deceleration $\alpha bk$ during the brake slip is calculated in a step S6 based on the brake slip time tbk counted in the step S4:

$$\alpha bk=(Vbs-Vbd)/tbk$$

The calculated result is outputted to the display 17. Note that the speed detection by the cage speed detecting means 23 is performed using an encoder to a governor or a pulse tachometer or the like.

The desired brake torque T is calculated in advance according to the following equation (1):

$$T=J(x).k.\alpha(x)+TL(x) \quad (1)$$

where J(x) is a total inertia moment of the elevator, k is a proportional constant, $\alpha(x)$ is a desired mean deceleration during the brake slip, and TL(x) is a load torque. Each of the foregoing parameters $\alpha(x)$, TL(x) and J(x) is a function depending on a cage load X, where X is expressed as a ratio of a rated load. When a value of a cage load X has been determined, each value of $\alpha(x)$, TL(x) and J(x) can easily be obtained by any one many known methods.

The value of the desired mean deceleration $\alpha(x)$ is shown on display 17 together with the value of the actual deceleration $\alpha bk$. The actual brake torque may be adjusted by comparing the actual mean deceleration $\alpha bk$ with the desired mean deceleration $\alpha(x)$. This comparison can be made by an operation in a machine room or it can be done electronically using commonly known comparison circuitry. If the actual mean deceleration lies between $\alpha(x)$ and $\Delta\alpha(x)$, then the actual brake torque is within an allowable range of the desired brake torque T. Preferably, $\Delta\alpha(x)$ has a value of 10% of $\alpha(x)$.

It is not necessary to load a weight into the cage to adjust the brake torque. For example, to obtain a brake torque adjusting value at a cage load of 125%, the desired mean deceleration $\alpha(x)$ during the brake slip can be calculated in advance from the brake torque T, the total inertia moment J(x) of the elevator, and the load torque TL(x) where X represents a cage load of 125%. This calculated value is indicated on the display 17 and, therefore, an operator, e.g., a maintainer, can adjust the brake torque so that the actual deceleration becomes $\Delta\alpha(x)$ of the calculated value. The values TL(x), J(x) and $\alpha(x)$ are calculated in advance and there is no need to load a weight into the elevator cage and before sending the cage down the elevator shaft.

In accordance with the invention, adjustment of the actual brake torque is performed by running the elevator cage without a load. At a selected time, the brake is actuated to stop the cage. While the cage is stopping, the microcomputer 1 calculates the actual deceleration $\alpha bk$ of the cage and transmits the actual deceleration to display 17. Also shown on display 17 is the desired mean deceleration $\alpha(0)$ (where x=0 because the cage has no load). To determine whether the brake torque is at its desired level, an operator judges whether the actual deceleration $\alpha bk$ is within the desired mean deceleration range of $\alpha(0)$ and $\Delta\alpha(0)$. If the actual deceleration is not within the mean deceleration range, the brake torque is not at its desired level and the brake torque must be further adjusted.

Preferably, the brake torque is adjusted by changing the force in the brake spring. Once the brake torque has been adjusted, the procedure set forth in the previous paragraph is repeated until the actual deceleration $\alpha bk$ lies within the desired mean deceleration range.

Figure 3:
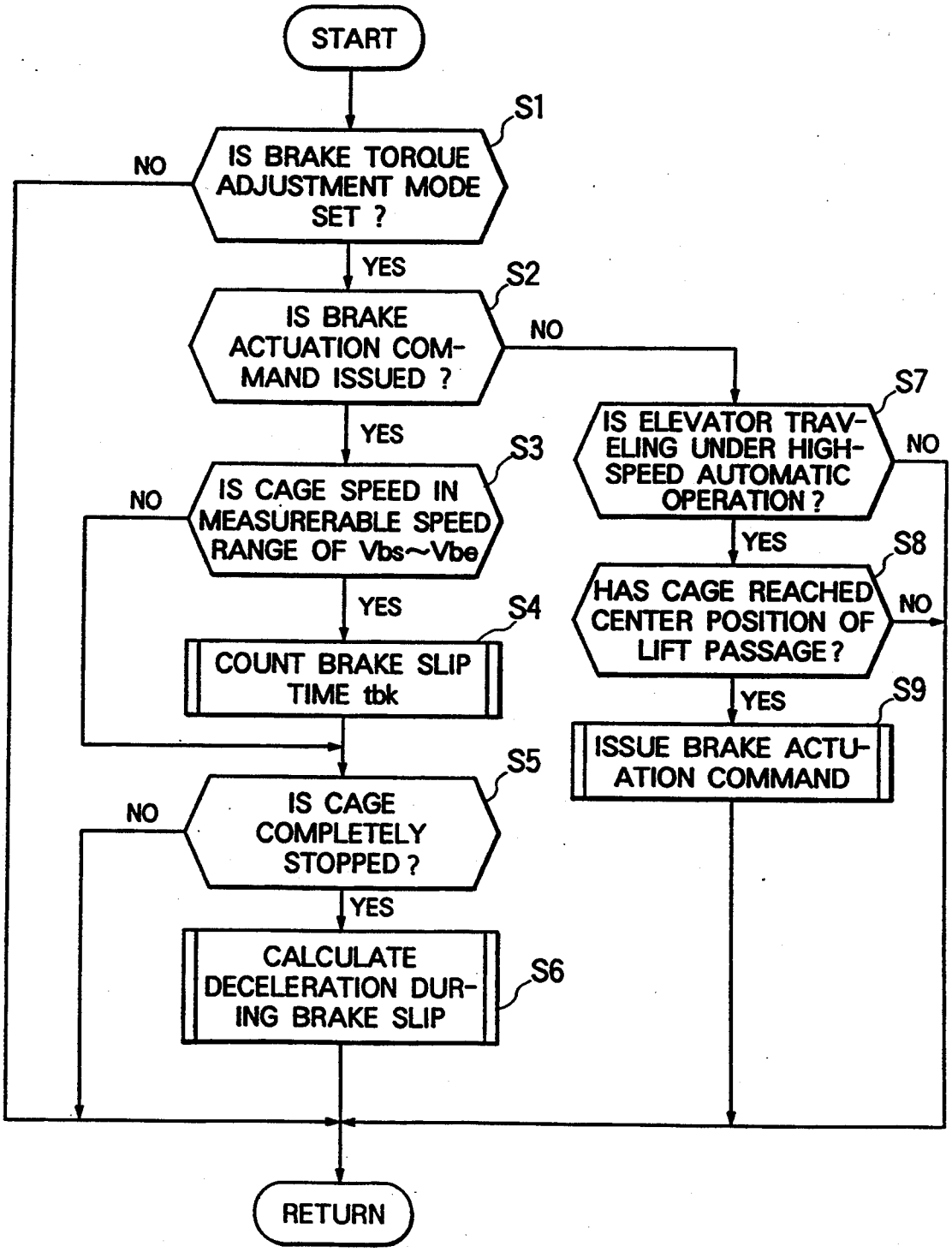
FIG. 3 is a flowchart showing operation of the first embodiment.
Figure 4:
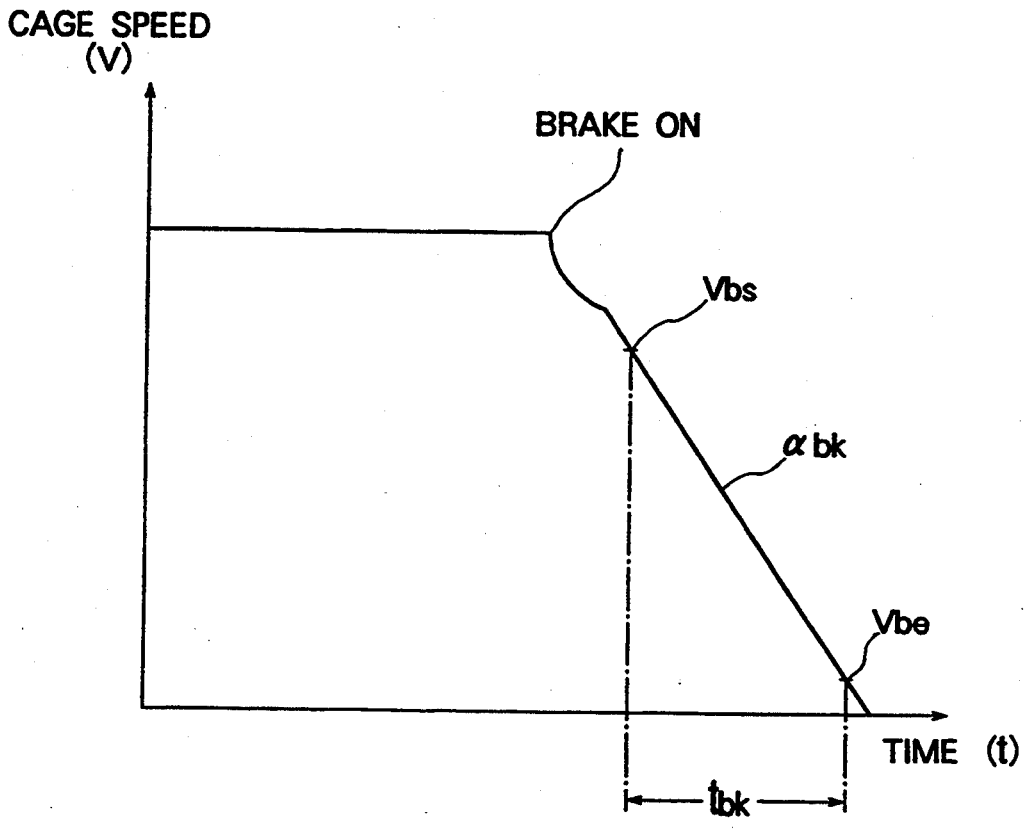
FIG. 4 is a characteristic graph of cage speed in the first embodiment.

FIG. 4 is a characteristic graph to supplement the flowchart of FIG. 3 and shows the process of the flowchart in the form of a graph. In other words, FIG. 4 shows changes in the cage speed resulting from issuance of the brake actuation command when the elevator cage 13 has reached the center position of the lift passage while the elevator is traveling at a rated speed under high-speed automatic operation. In FIG. 4, Vbs represents a measurement start speed in the brake slip time tbk, Vbe represents a measurement end speed in the brake slip time tbk. Also, $\alpha bk$ represents the actual mean deceleration during brake slip time tbk.

While the above embodiment uses a comparison between the actual mean deceleration $\alpha bk$ during brake slip time tbk and the desired mean deceleration $\alpha(x)$ to adjust brake torque, this adjustment may be made according to distance of travel from the brake torque measurement speed Vbs to 0 (i.e., an integral value of the measurement speed over time). It is apparent that the distance of travel S from the brake torque measurement speed Vbs to 0 is expressed by the following equation (3):

$$S = Vbs^2/2\alpha bk = Vbs^2 j.k/2(T-TL) \quad (3)$$

As explained above, with the elevator adjusting apparatus of this first embodiment, when the brake torque adjustment mode is set by the brake torque adjustment mode setting means 21, the brake actuation command generating means 24 issues the brake actuation command at the time the cage position recognizing means 22 recognizes that the elevator cage 13, while traveling, has reached the center position of the lift passage. Simultaneously, the brake torque calculating means 25 calculates the brake torque at that time and the calculated result is indicated on the display 17.

Accordingly, the calculated result of the brake torque can be accurately known from the display 17. This allows an operator, e.g., a maintainer, to properly adjust the brake torque so that it becomes equal to the calculated value. Therefore, the operations of adjusting the brake torque can be totally performed in a machinery room with no need of loading a weight unlike the prior art, making it possible to save time and labor necessary for loading and unloading a weight. Further, the brake is not tightened too strong or too weak and the brake torque can be adjusted in conformity the desired standards. As a result, the adjusting operations can be simplified and the brake torque can be adjusted accurately and efficiently.

Second Embodiment

Figure 5:
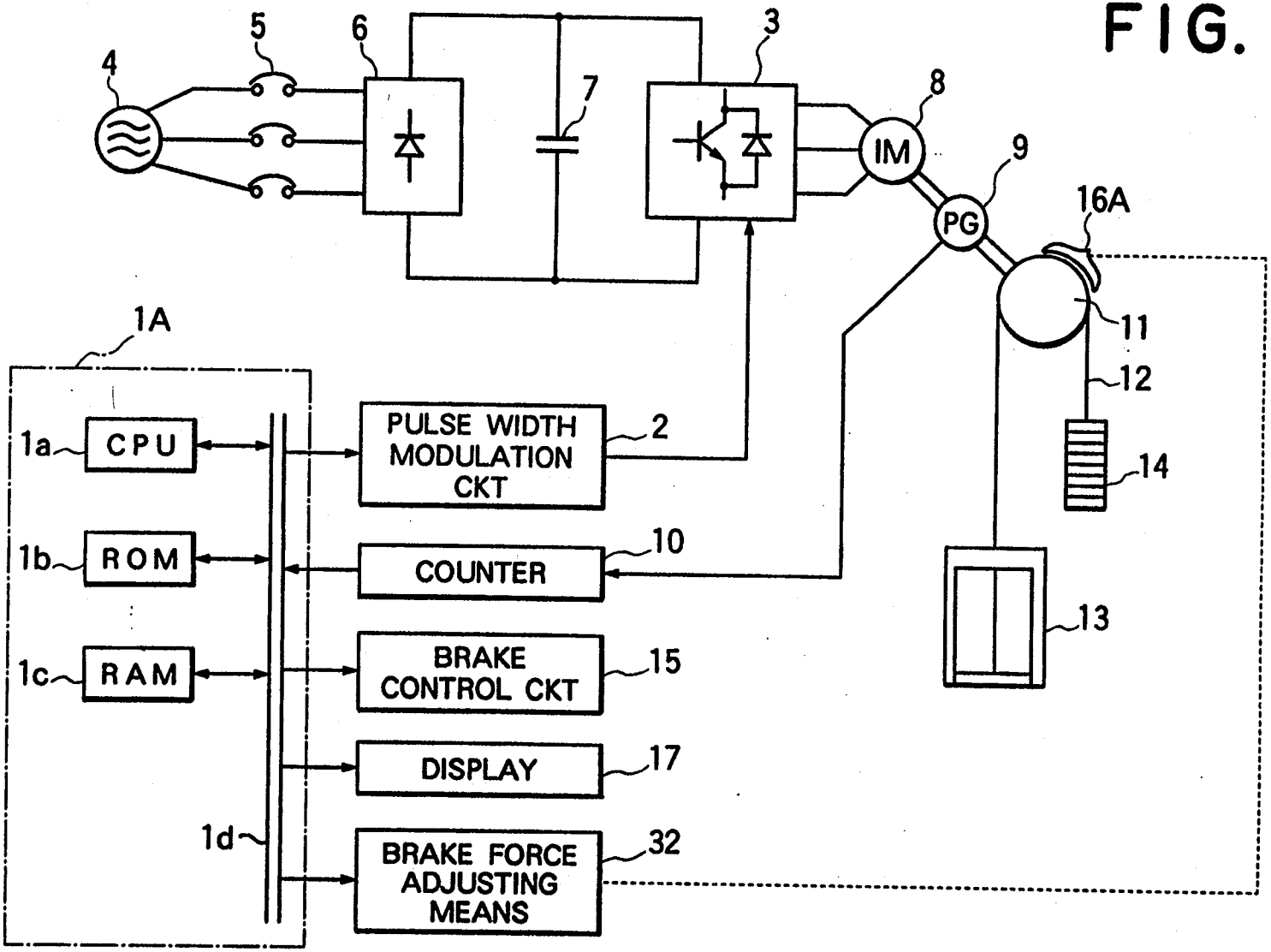
FIG. 5 is a block diagram showing an entire system of an elevator adjusting apparatus according to a second embodiment of the present invention.
Figure 6:
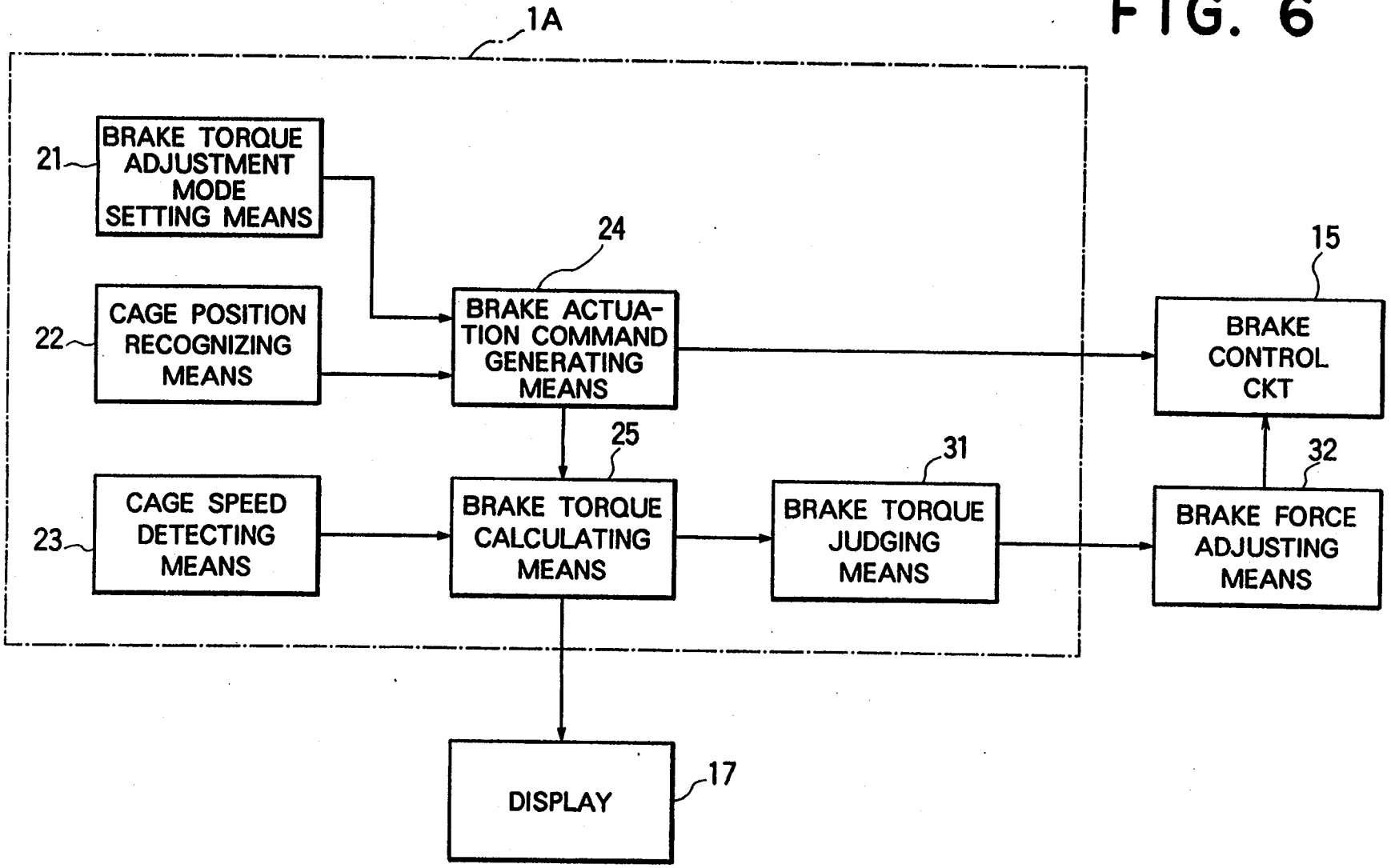
FIG. 6 is a functional block diagram of a microcomputer in FIG. 5.

FIG. 5 shows an entire system of an elevator adjusting apparatus according to a second embodiment of the present invention. This second embodiment is different from the first embodiment of FIG. 1 in that a microcomputer 1A is provided in place of the microcomputer 1 and brake force adjusting means 32 for adjusting brake forces of the electromagnetic brake 16 is connected to the microcomputer 1A. The microcomputer 1A constitutes a mechanism for calculating the brake torque and its functional block diagram is shown in FIG. 6. The microcomputer 1A has brake torque judging means 31 connected to the brake torque calculating means 25, which is the same as that in the microcomputer 1 of the first embodiment, the brake torque judging means 31 being connected to the brake force adjusting means 32. The brake torque judging means 31 judges from a signal from the brake torque calculating means 25 whether or not the calculated value of the brake torque is in a predetermined range, and outputs the judgment result to the brake force adjusting means 32.

Figure 7:
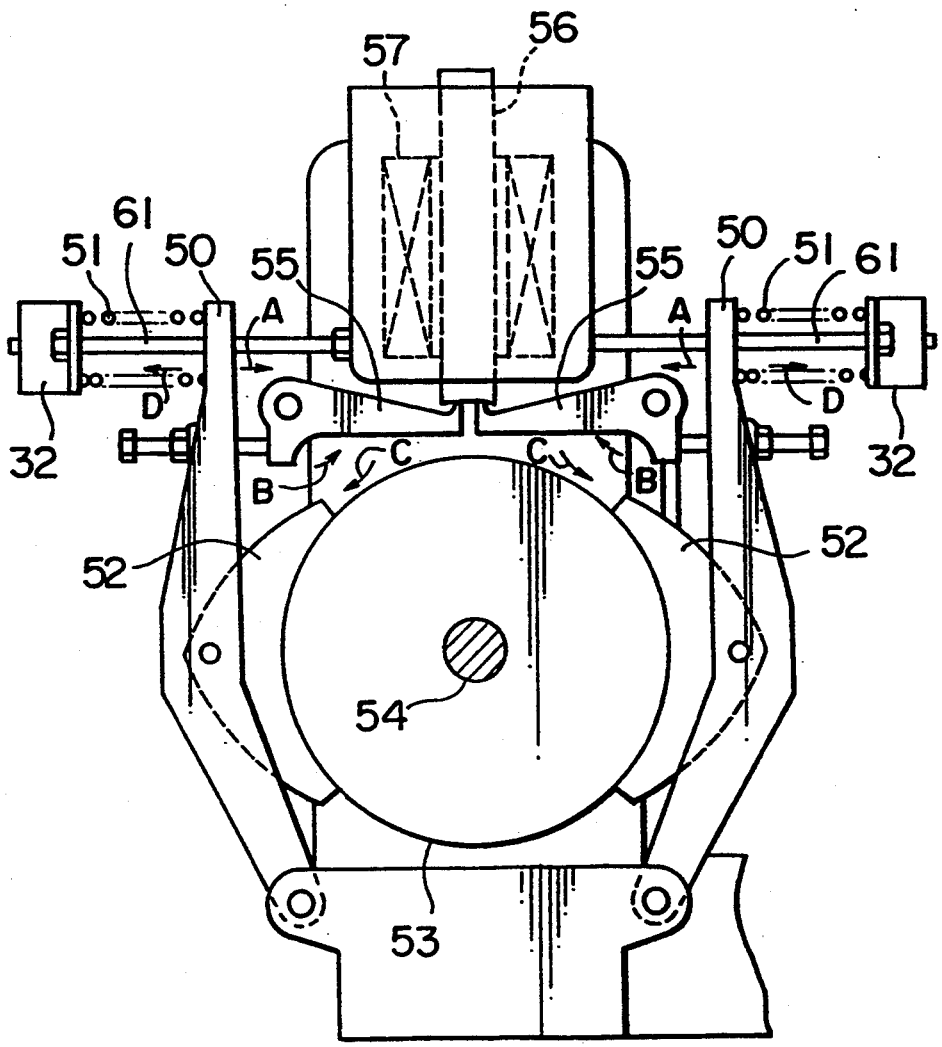
FIG. 7 is a view showing an electromagnetic brake on which brake force adjusting means of FIG. 5 is mounted.

FIG. 7 shows the structure of an electromagnetic brake 16 on which the brake force adjusting means 32 is mounted in pair. The brake force adjusting means 32 is provided at one end of a support rod 61 around which a spring 51 for biasing a brake lever 50 is fitted. Based on the judgement result from the brake torque judging means 31, the brake force adjusting means 32 actuates an internal plunger (not shown) to thereby adjust a biasing force of the spring 51.

Operation of calculating the brake torque and operation of adjusting the brake torque in the elevator adjusting apparatus of this second embodiment will be described with reference to the flowchart of FIG. 8. The process from a step S1 to a step S9 represents the operation of calculating the brake torque, and is identical to the process from the step S1 to the step S9 in the first embodiment explained above by referring to FIG. 3. Therefore, the following description is primarily focused on the operation of adjusting the brake torque as represented in the process subsequent to the step S10.

When the mean deceleration during the brake slip is calculated in step S6, a brake torque adjusting value is obtained based on the calculated deceleration and, thereafter, it is determined in a step S10 whether or not the brake torque adjusting value is in a specified range. If so, then the process of steps S11 to S13 is skipped for return to the main routine without adjusting the brake torque, followed by continuing control of the elevator. On the other hand, if the brake torque adjusting value is determined in step S10 as being out of the specified range, then the process goes to step S11 to determine whether or not the brake torque adjusting value is below the specified range. If so, then a command of tightening the plunger is issued to the brake force adjusting means 32 in step S12, thereby enlarging the biasing force of the spring 51. Subsequently, the process returns to step S1 to perform the operation of calculating the brake torque and, thereafter, step S10 determines again whether or not the brake torque adjusting value is in the specified range. Meanwhile, if the brake torque adjusting value is over the specified range, then a command of loosening the plunger is issued to the brake force adjusting means 32 in step S13, thereby diminishing the biasing force of the spring 51. Subsequently, the process returns to step S1 to perform the operation of calculating the brake torque and, thereafter, step S10 determines again whether or not the brake torque adjusting value is in the specified range. In this way, a series of the above adjusting operations is repeated until the brake torque adjusting value is in the specified range.

As explained above, with the elevator adjusting apparatus of this second embodiment, similar to the first embodiment, when the brake torque adjustment mode is set by the brake torque adjustment mode setting means 21, the brake actuation command generating means 24 issues the brake actuation command at the time the cage position recognizing means 22 recognizes that the elevator cage 13, while in traveling, has reached the center position of the lift passage. Simultaneously, the brake torque calculating means 25 calculates the brake torque at that time. Then, the brake torque is adjusted by the brake torque judging means 31 and the brake force adjusting means 32 so that the calculated value is in the specified range.

Accordingly, the brake torque can be automatically adjusted from time to time, which eliminates the need of adjusting the brake torque by an operator, e.g., a maintainer. Therefore, the adjustment of the brake torque can be made with no need of loading a weight unlike the prior art, making it possible to save time and labor necessary for loading and unloading a weight. Further, the brake is not tightened too strong or too weak and the brake torque can be automatically adjusted in conformity with certain standards. As a result, the adjusting operations can be simplified and the brake torque can be adjusted accurately and efficiently.

As an alternative embodiment, taking into account safety of the operator and other persons, the speed of the elevator cage 13 at which the brake actuation command is issued by the brake actuation command generating means 24 may be set to a lower value for setting the brake torque than then rated speed.

Influences of unbalenced cable and unbalanced rope are minimum and a more accurate measurement result is obtained when the position of the elevator cage 13 at which the brake actuation command is to be issued is selected as the center of the lift passage in the above embodiments. However, that position may be set near the uppermost stage in the absence of a cage load, or near the lowermost stage when the cage load is equal to the rated load. In these cases, the brake torque can be adjusted to correspond to special situations including the unbalanced cable and unbalanced rope conditions.

In the above embodiments, the recognition of the cage position by the cage position recognizing means 22 is carried out in parallel to the travel of the elevator cage 13 by detecting the amount of movement of the elevator cage 13, and recognizing the center position of the lift passage. However, the cage position near the uppermost or lowermost stage may be recognized in a like manner. Alternatively, the cage position may be recognized by providing a switch for recognizing the center position of the lift passage, or by utilizing a terminal switch for recognizing the terminal stage when the position to be recognized is set near the uppermost stage or the lowermost stage.

What is claimed is:

1. A method of setting and adjusting a brake torque in an adjustable brake of an elevator comprising:

measuring the speed of an elevator cage;

sensing the position of the elevator cage;

actuating a braking operation to reduce the speed of the cage upon sensing that the cage has reached a predetermined position;

measuring brake slip time where brake slip time is defined as the time period in which the cage speed changes from a first speed $V_{bs}$ to a second speed $V_{bc}$;

calculating the average cage deceleration during brake slip time;

calculating brake torque based on the average cage deceleration;

adjusting the brake when the brake torque lies outside a predetermined range.

2. An elevator adjusting apparatus for adjusting a brake torque produced by a brake for braking travel of an elevator cage, the apparatus comprising:

brake torque adjustment mode setting means for setting an adjustment mode for the brake torque, cage position recognizing means for recognizing a cage position, cage speed detecting means for detecting a cage speed, brake actuation command generating means for issuing a brake actuation command when the brake torque adjustment mode is set by said brake torque adjustment mode setting means and said cage position recognizing means recognizes that the cage position has reached a predetermined position of a lift passage, brake control means for actuating said brake in response to the brake actuation command issued from said brake actuation command generating means, and brake torque calculating means for calculating the brake torque based on the cage speed detected by said cage speed detecting means during the brake actuation, means for adjusting the brake torque so that the brake torque lies within a predetermined range, said means including an adjustment means for generating a first adjustment signal when the brake torque is above an upper limit and for generating a second adjustment signal when the brake torque is below a lower limit.

3. A method as set forth in claim 1 further comprising comparing the average deceleration with a predetermined deceleration.

4. The method of claim 3 wherein said adjusting step includes adjusting the brake torque until the average deceleration is within ±10% of the predetermined deceleration.

5. The method of claim 1 wherein said adjusting step includes adjusting the brake to increase the brake torque when the brake torque is below a lower limit of the predetermined range of values.

6. The method of claim 1 wherein said adjusting step includes adjusting the brake to decrease the brake torque when the brake torque is above an upper limit of the predetermined range of values.

7. An apparatus for operating an adjustable brake for an elevator cage comprising:

cage position recognizing means for recognizing a cage position;

brake actuation command generating means for issuing a brake actuation command when said cage position recognizing means recognizes that the cage position has reached a predetermined position of a lift passage;

cage speed detecting means for detecting a cage speed;

brake control means for actuating said brake in response to the brake actuation command issued from said brake actuation command generating means;

means for determining a time period during which the cage speed remains between a first speed and a second speed during actuation of the brake, the time period being designated as a brake slip time;

means for calculating mean deceleration during the brake slip time;

means for comparing the mean deceleration to a predetermined deceleration; and means for adjusting the brake so that the mean deceleration lies within a predetermined deceleration range.

8. The apparatus of claim 7 wherein the predetermined deceleration range includes within ±10% of the predetermined deceleration.

9. An elevator apparatus according to claim 7 wherein said means for adjusting the brake torque includes an adjustment means for generating a first adjustment signal when the brake torque is above an upper limit and for generating a second adjustment signal when the brake torque is below a lower limit.

10. An elevator adjusting apparatus according to claim 7, wherein said brake actuation command generating means issues the brake actuation command when the cage position recognized by said cage position recognizing means has reached the center position of said lift passage.

* * * * *